US006406123B1

(12) United States Patent
Usui et al.

(10) Patent No.: US 6,406,123 B1
(45) **Date of Patent: *Jun. 18, 2002**

(54) CAPPING UNIT FOR INK JET RECORDING HEAD INCORPORATED IN INK JET RECORDING APPARATUS AND METHOD OF MANUFACTURING THE SAME

(75) Inventors: Minoru Usui; Hitoshi Hayakawa; Kazuhiko Hara; Shigenori Fukasawa; Katsuhiro Komatsu, all of Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/389,586

(22) Filed: Sep. 3, 1999

(30) Foreign Application Priority Data

| | | |
|---|---|---|
| Sep. 7, 1998 | (JP) | 10-252114 |
| Nov. 12, 1998 | (JP) | 10-322011 |
| Nov. 26, 1998 | (JP) | 10-336329 |

(51) Int. Cl.[7] ..... B41J 2/165
(52) U.S. Cl. ..... 347/29
(58) Field of Search ..... 347/29, 30

(56) References Cited

U.S. PATENT DOCUMENTS

| | | | | |
|---|---|---|---|---|
| 5,146,243 A | | 9/1992 | English et al. | 346/140 |
| 5,252,993 A | * | 10/1993 | Tomii et al. | 347/29 |
| 5,539,435 A | * | 7/1996 | Uchida et al. | 347/33 |
| 5,670,997 A | * | 9/1997 | Sugimoto et al. | 347/30 |
| 5,828,389 A | * | 10/1998 | Yamaguchi et al. | 347/23 |
| 5,883,645 A | * | 3/1999 | Ikado et al. | 347/30 |
| 5,956,053 A | * | 9/1999 | Michael | 347/29 |

FOREIGN PATENT DOCUMENTS

| | | | | |
|---|---|---|---|---|
| EP | 0 451 460 A2 | | 10/1991 | B41J/11/04 |
| EP | 0 540 344 A2 | | 5/1993 | B41J/2/165 |
| EP | 0 541 519 A2 | | 5/1993 | B41J/2/165 |
| EP | 0 552 030 A1 | | 7/1993 | B41J/2/165 |
| EP | 0744294 | * | 11/1996 | |
| JP | 61-213145 | | 9/1986 | B32B/25/08 |
| JP | 5-23952 | | 4/1993 | B41J/2/175 |
| JP | 5-131639 | | 5/1993 | B41J/2/165 |
| JP | 5-246457 | | 9/1993 | |
| JP | 6-31770 | | 2/1994 | |
| JP | 6-198902 | | 7/1994 | B41J/2/175 |
| JP | 8-25225 | | 3/1996 | B29C/65/02 |
| JP | 8-99331 | | 4/1996 | B29C/45/14 |
| JP | 2527157 | | 6/1996 | B32B/27/32 |
| JP | 09314853 | * | 9/1997 | |

* cited by examiner

*Primary Examiner*—N. Le
*Assistant Examiner*—Shih-wen Hsieh
(74) *Attorney, Agent, or Firm*—Sughrue Mion, PLLC

(57) ABSTRACT

A capping member for an ink jet recording head is composed of a cap which is to be brought into contact with a surface of the recording head provided with nozzle orifices, and a cap case for holding the cap. A passage communicating an internal space defined by the cap with a suction hole connected to a suction pump and a passage communicating the internal space with an air hole connected to the outside are respectively formed into a specific shape so as to inhibit vaporization of an ink solvent in the internal space. A tube made of an elastic and restorative material is used for a tube connected to the suction pump. A tube made of a material having high gas-barrier characteristic is used for a tube connected to the capping member. Both of the tube is connected with each other by a connecting member in order to inhibit vaporization of an ink solvent from the tubes. Accordingly, the reliability of printing operation when printing is restarted after the long-term halt of the ink jet recording head is remarkably enhanced. The cap may be formed by fitting into a groove formed on a brim portion of the cup-shaped cap case having high rigidity. Therefore, elasticity of the cap can be controlled by the height thereof and can be deformed uniformly for whole periphery of the brim portion to attain high airtightness of the cap.

33 Claims, 14 Drawing Sheets

CAPPING UNIT FOR INK JET RECORDING HEAD INCORPORATED IN INK JET RECORDING APPARATUS AND METHOD OF MANUFACTURING THE SAME

BACKGROUND OF THE INVENTION

The present invention relates to a capping unit for an ink jet recording head incorporated in an ink jet recording apparatus, and a method of manufacturing the same. In particular, the ink jet recording apparatus comprises: an ink jet recording head installed on a carriage moved in the widthwise direction of recording paper, for jetting ink droplets from nozzle orifices by pressurizing ink from an ink tank supplied into associated pressure generating chamber by a pressure generating member such as piezoelectric vibrators, heating elements or the like; and a capping unit provided with a capping member for sealing a surface of the recording head on which the nozzle orifices are formed (hereinafter, the nozzle-formed surface), and receiving negative pressure generated by a negative pressure generating member, wherein vaporization of an ink solvent from the capping member is inhibited during the halt of recording operation in order to prevent from clogging of the nozzle orifices.

As for an ink jet recording apparatus, noise in printing is relatively small and in addition, small dots can be formed in high density, such an ink jet recording apparatus is currently used for many types of printing including color printing.

The ink jet recording apparatus described above provided with an ink jet recording head to which ink from an ink cartridge is supplied, and a paper feeding mechanism for relatively moving recording paper under the recording head. The recording is performed by jetting ink droplets onto the recording paper, moving the recording head on a carriage in the widthwise direction of the recording paper.

Recording heads for jetting black ink and each color ink of yellow, cyan and magenta are mounted on the carriage, and full color printing is enabled by changing the ratio of the jetting of each ink in addition to text printing by black ink.

The above ink jet recording head has a problem that printing failure is caused by the increase of ink viscosity caused by the vaporization of a solvent from nozzle orifices, the solidification of ink, the adhesion of dust, further the mixture of bubbles or the like, because the printing is performed by jetting ink pressurized in the pressure generating chambers onto recording paper from nozzle orifices as an ink droplet.

Therefore, the above ink jet recording apparatus is provided with: a capping member normally composed of a plastic cap holder (cap case) and a cap made of elastic material such as rubber for sealing the nozzle orifices of the recording head while the printing is halted; and a cleaning member for cleaning a nozzle plate if necessary.

The above capping member not only functions as a cap for preventing ink at nozzle orifices from drying while printing is halted but is provided with functions for sealing the nozzle plate by the cap in case the nozzle orifices are clogged, sucking ink from the nozzle orifices by negative pressure generated by a suction pump as a negative pressure generating member, and solving the clogging caused by the solidification of ink at the nozzle orifices and a failure in the jetting of ink caused by bubbles mixed in an ink passage.

FIG. 23 schematically shows a state in which the nozzle-formed surface of the recording head is sealed by the capping member.

As shown in FIG. 23, the capping member 10 is provided with a rectangular cap case 10*a* the upper face of which is opened and a cap 10*b* housed in the cap case 10*a* and made of flexible material such as rubber material, and the cap 10*b* is formed so that the upper edge thereof is slightly protruded from the top face of the cap case 10*a*.

An ink absorber 10*c* made of porous material is housed at the inner bottom of the cap 10*b* and is held by a holder 10*d* integrally formed with the cap 10*b*.

A suction hole 10*e* and an air hole 10*f* are formed at the bottom of the cap case 10*a* and penetrate the cap case 10*a* and the cap 10*b*.

A suction pump 11 as a negative pressure generating member is connected to the suction hole 10*e* of the cap case 10*a* via a tube T1 and discharge side of the suction pump 11 is connected to a waste ink tank 13.

Further, an air valve 14 is connected to the air hole 10*f* of the cap case 10*a* via a tube T2.

In the meantime, a reference number 7 in FIG. 23 denotes a recording head. As the capping member 10 is moved upwards when the recording head 7 is moved toward above the capping member 10, the nozzle-formed surface, that is, a nozzle plate 7*a* is sealed (capped) by the above cap 10*b*.

Plural nozzle orifices 7*b* are formed on the nozzle plate 7*a*, and black ink and each color ink such as yellow, cyan and magenta are jetted by the action of a piezoelectric vibrator 7*c* arranged corresponding to each nozzle orifices 7*b*.

Owing to the above structure, ink is sucked from the recording head in a state in which the cap 10*b* is adhesively contacted to the nozzle plate 7*a* of the recording head 7 and the air valve 14 is closed as shown in FIG. 23.

That is, negative pressure is applied to the internal space of the cap 10*b* by operating the suction pump 11 in this state and ink is discharged from the nozzle orifices 7*b*.

When the above air valve 14 is opened while the suction pump is halted in a predetermined time and the negative pressure inside the cap decreases to some extent because ink is discharged, the air is introduced inside the cap and inside negative pressure is released.

When the suction pump 11 is operated again in a state in which the air valve 14 is opened, operation for sending ink discharged inside the cap to a waste ink tank 13 via the tube T1 is executed.

In the meantime, while the printing is halted, the nozzle-formed surface of the recording head, that is, the nozzle plate 7*a* is sealed by the cap 10*b* as shown in FIG. 23, the above air valve 14 is closed and the internal space of the cap 10*b* is kept moist by an ink solvent. Hereby, the nozzle orifices of the recording head is prevented from being clogged by drying, and the reliability of printing operation when printing is restarted can be secured.

However, there is a problem that the ink solvent is vaporized in a passage communicating from the internal space of the cap to the suction hole or the air hole and further, in a path which leads to the suction pump connected to the suction hole and the air hole and the air valve.

FIG. 24 shows an example which is a sectional view showing a passage making the internal space of a cap and a suction hole communicate in an example of a cap case in capping member currently used.

The same reference number is allocated to a part shown in FIG. 24 equivalent to the part already described and shown in FIG. 23 and therefore, the description is omitted.

As shown in FIG. 24, the passage 10*g* for making the internal space of the cap and the suction hole 10*e* communicate is formed so that the inner diameter is relatively large and the length is relatively short. A reference number 10*n* denotes a fitting member for fitting the cap.

As described above, in a state in which the passage 10*g* is formed so that the inner diameter is large and the length is short, there is a problem that flow resistance on the side of a suction pump is small and therefore, the vaporization to the outside of an ink solvent is caused in a tube connected to the suction pump.

Particularly, for the suction pump, a low-cost tube pump which is securely operated is used and for a tube composing the tube pump, elastic and restorable silicon rubber is used.

However, silicon rubber has a problem that it is relatively inferior in gas-barrier characteristic, and thereby an ink solvent would be vaporized from the tube to the outside.

Therefore, as an ink solvent is gradually vaporized from the internal space of the cap via the above passage and a moist state in the cap is deteriorated in case a recording apparatus is halted for a long term, clogging in the nozzle orifices of the recording head is caused.

After the recording apparatus is halted for a long term, so-called timer cleaning that ink is automatically sucked from the nozzle orifices of the recording head when the recording apparatus is powered on is executed, however, when the solid material of ink is deposited in the minute nozzle orifices of the recording head, it is not easy to remove the solid material by the suction of ink and a problem that the reliability of printing operation is deteriorated is caused.

The tube pump used for this type of recording apparatus is driven by utilizing the power of a paper feeding motor or the like which is not used while the printing is halted in order to suck ink from the nozzle orifices.

The above tube pump is composed of an arcuate face for supporting a tube therealong and a roller which rolls while pressing the tube onto the supporting face. Therefore, for the material of the tube composing the tube pump, elastic and restorable silicon rubber is generally used.

The sucking side of the tube made of silicon rubber is connected to the suction hole of the above capping member.

If the above silicon rubber is used for the tube pump, the elastic and restorable characteristic can be utilized, however, silicon rubber has a problem that it is relatively inferior in the gas-barrier characteristic as described in the above, a rate in which an ink solvent is vaporized from the tube to the outside is considerably large.

Further, recently, as a cap is also lengthened according to the large sizing of a recording head, there is a problem that deflection and deformation are easily caused when the cap is touched to the recording head, a gap is made between the recording head and the cap and airtightness is deteriorated.

Such a problem can be solved by forming pleats at the top end of the cap in order to balance rigidity and elasticity, and suitably installing the cap in a cap holder. However, there is a problem that initial performance cannot be fulfilled by the aging change of the rigidity and elasticity of the cap, the reliability is deteriorated and others in addition to a problem that the process becomes complicated.

To solve such problems, as disclosed in Japanese Patent Publication Nos. 61-213145A and 8-99331A for example, it is proposed that a member to function as a base is formed by first polymeric material by injection molding and an attachment is fixed by using the metallic mold as it is or reinstalling the base in a second metallic mold and injection-molding second polymeric material on the base.

However, it is very difficult to acquire sufficient precision to form a packing member the volume of which is at most substantially 20 cc and the thickness of which is a few mm as a cap for sealing nozzle orifices.

SUMMARY OF THE INVENTION

The present invention is made to solve the problems of the above related ink jet recording apparatus and the object is to provide an ink jet recording apparatus wherein a moist state in the internal space of a capping member can be maintained for a long term and the reliability of printing by a recording head can be enhanced.

Another object of the present invention is to provide a capping unit by which the recording head can be securely sealed for a long term and a method of manufacturing the same simply.

In order to achieve the above objects, there is provided an ink jet recording apparatus comprising: an ink jet recording head having a surface provided with nozzle orifices from which ink droplets are ejected; and a capping member for sealing the surface provided with the nozzle orifices to apply negative pressure generated by a negative pressure generating member. The capping member includes: a cap made of flexible material, which is to be abutted against the surface provided with the nozzle orifices; a cap case for holding the cap; a suction hole to which the negative pressure generating member is connected; and a first passage formed in either the cap or the cap case for communicating the internal space with the suction hole.

In the apparatus, the capping member may further include: an air hole to which a valve introducing external air into an internal space defined by the cap; and a second passage formed in either the cap and the cap case for communicating the internal space with the air hole. Here, at least the first passage between the first and second passages is formed into a shape capable of inhibiting vaporization of an ink solvent in the internal space.

In the apparatus, the cap may be bonded on an inner face of the cap case.

In the apparatus, the cap may be integrally formed on an upper portion of the cap case.

In the apparatus, a cylindrical body may be formed integrally with the cap case so as to protruded from a bottom face of the case. At least the first passage between the first and second passages may be formed in the cylindrical body.

In the apparatus, a metal tube member may be inserted into at least the suction hole between the suction hole and the air hole.

In the apparatus, at least the first passage between the first and second passages may be formed by a groove formed along an outer peripheral face of the cap case and a seal member for sealing the groove. The sealing member may be made of at least one material selected from the group consisting of an aluminum deposited film, a silicon oxide deposited film, polyethylene terephthalate, undrawn polypropylene, ethylene-vinylalcohol, ethylene-vinyl acetate copolymer, polyvinylidene chloride, and cyclic olefin copolymer.

In the apparatus, at least the first passage between the first and second passages may be formed by a groove formed on the inner face of the cap case.

In the apparatus, at least the first passage between the first and second passages may be formed by a groove formed on a bottom face of the cap.

According to the ink jet recording apparatus configured as described above, the vaporization of the ink solvent from the internal space is inhibited. Hereby, a moist state of an ink solvent in the internal space of the capping member can be maintained for a long term.

Therefore, the degree of the occurrence of the clogging of nozzle orifices in the recording head while the recording apparatus is halted for a long term can be reduced, a frequency in which so-called timer cleaning is executed can be reduced and if timer cleaning is executed, the reliability of printing in the recording head can be sufficiently recovered.

The apparatus further comprises: a first tube made of a material having high gas-barrier characteristic and connected to the suction hole; and a second tube member made of an elastic and restorative material for connecting the negative pressure generating member with the first tube.

In the apparatus, the negative pressure generating member is a tube pump including a supporting face for supporting the second tube in the shape of an arc and a roller rotating while pressing the second tube onto the supporting face.

In the apparatus, a tube made of butyl rubber is used as the first tube, and a tube made of silicon rubber is used as the second tube.

According to the ink jet recording apparatus configured as described above, the vaporization of an ink solvent from the tube while the recording apparatus is halted can be effectively inhibited.

Therefore, the degree of the occurrence of the clogging of nozzle orifices in the recording head while the recording apparatus is halted for a long term can be reduced and the reliability of printing in the recording head can be sufficiently recovered by executing so-called timer cleaning.

If the recording apparatus is halted for relatively a short term, the reliability of printing can be secured without executing the above timer cleaning.

In the apparatus, the cup casing may be formed into a shape of cup having a brim portion on which an annular groove into which the cap is fitted is formed.

In the apparatus, the cap case may be made of polymeric material, and the cap may be made by the injection molding of the flexible material.

In the apparatus, the width of a bottom face of the cap may be equal or wider than the width of the brim portion of the cap casing.

In the apparatus, the cap may be bonded onto the brim portion of the cap case.

In the apparatus, the cap case may be made of either polypropylene or polyethylene, and the cap may be made of either styrene thermoplastic elastomer or styrene thermoplastic elastomer composite materials.

In the apparatus, the groove may be provided with a portion communicating with the outside.

In the apparatus, the injection molding is conducted by the steps of: sealing the groove on the brim portion by a mold defining a shape of the cap; and injecting the material which is to be the cap into the mold.

In the apparatus, a first port from which the material which is to be the cap is injected and a second port from which air in the mold is discharged is formed in either the groove on the brim portion or the mold.

According to the ink jet recording apparatus configured as described above, the cap case having high rigidity can be prevented from being deformed, and the whole periphery of the cap held by the cap case can be uniformly deformed owing to elasticity controlled depending upon the height thereof. Therefore, the airtightness of the cap for the recording head can be secured.

DETAILED DESCRIPTION OF THE PREFERRED EMBODIMENTS

An ink jet recording apparatus according to the present invention will be described below with reference to the accompanying drawings.

Figure 1:
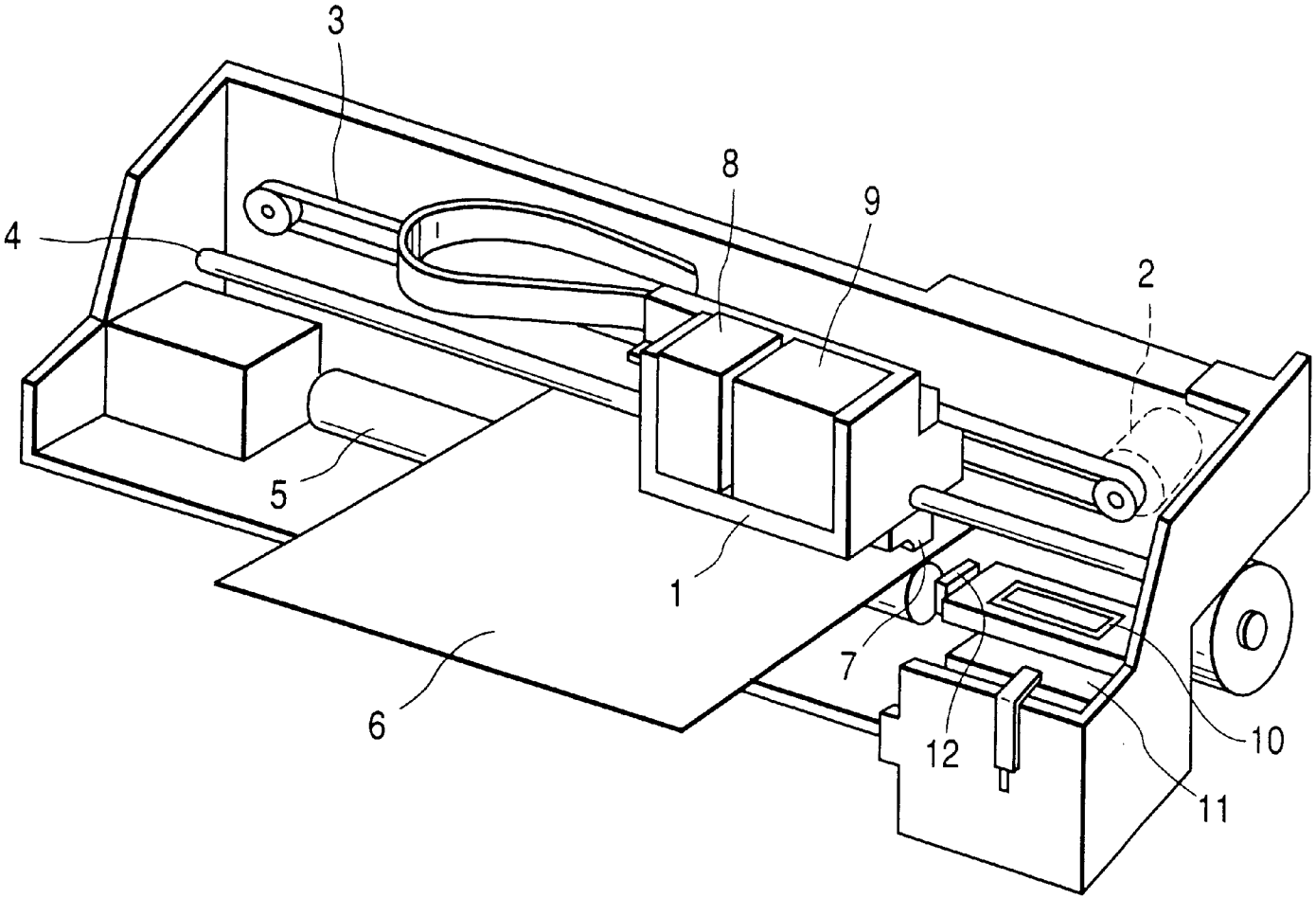
FIG. 1 is a perspective view showing a main body of an ink jet recording apparatus to which the present invention is applied.

FIG. 1 is a perspective view showing the whole configuration of a main body of an ink jet recording apparatus to which the present invention is applied.

As shown in FIG. 1, a reference number 1 denotes a carriage and the carriage is constituted so that it is reciprocated in the axial direction of a platen 5, being guided by a guide member 4 via a timing belt 3 driven by a carriage motor 2.

An ink jet recording head 7 is mounted on the side opposite to recording paper 6 of the carriage 1, and an ink cartridge 8 for black and an ink cartridge for color 9 respectively for supplying ink to the above recording head 7 are detachably mounted on the carriage.

A reference number 10 denotes a capping member arranged in a non-printing area (in a home position) and the capping member is constituted so that the nozzle-formed surface of the recording head 7 can be sealed when the recording head 7 is moved on the capping member.

A suction pump 11 as a negative pressure generating member for applying negative pressure to the inside space of the capping member 10 is arranged under the capping member 10.

Figure 23:
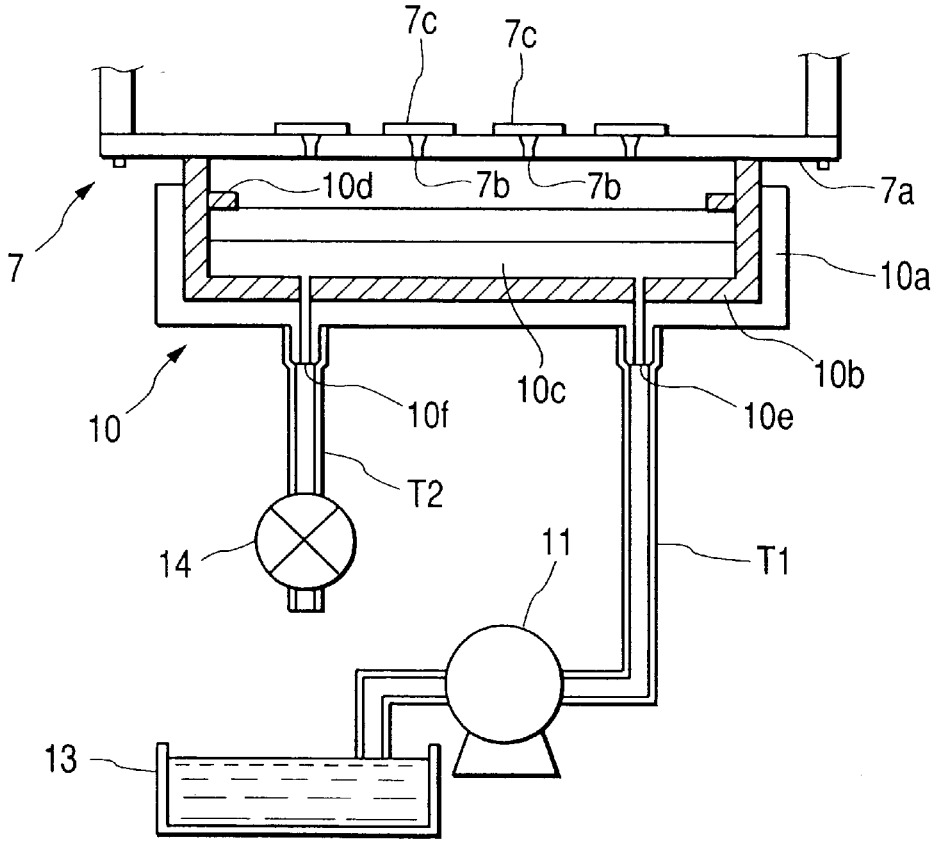
FIG. 23 is a sectional view showing a related capping member and a peripheral configuration thereof.

As has been already described with reference to FIG. 23, the above capping member 10 is composed of a cap 10*b* made of flexible material abutting against the nozzle-formed surface 7*a* of the recording head 7 and a cap case 10*a* for holding the outside surface of the cap 10*b*. The capping member 10 serves as a cover for preventing the nozzle orifices 7*b* of the recording head 7 from drying while the recording apparatus is halted, and as an ink receiver during a flushing operation in which a drive signal unrelated to printing is transmitted to the recording heads for the ejection of ink droplets, and is also provided with a cleaning function for applying negative pressure generated by the suction pump 11 to the recording head 7 so as to suck ink therefrom.

As shown in FIG. 1, a wiping member 12 composed of an elastic plate such as rubber is arranged in the vicinity of the capping member 10 and wiping operation in which the nozzle-formed surface of the recording head 7 is wiped when the carriage 1 is reciprocated on the side of the capping member 10 is executed.

Figure 2:
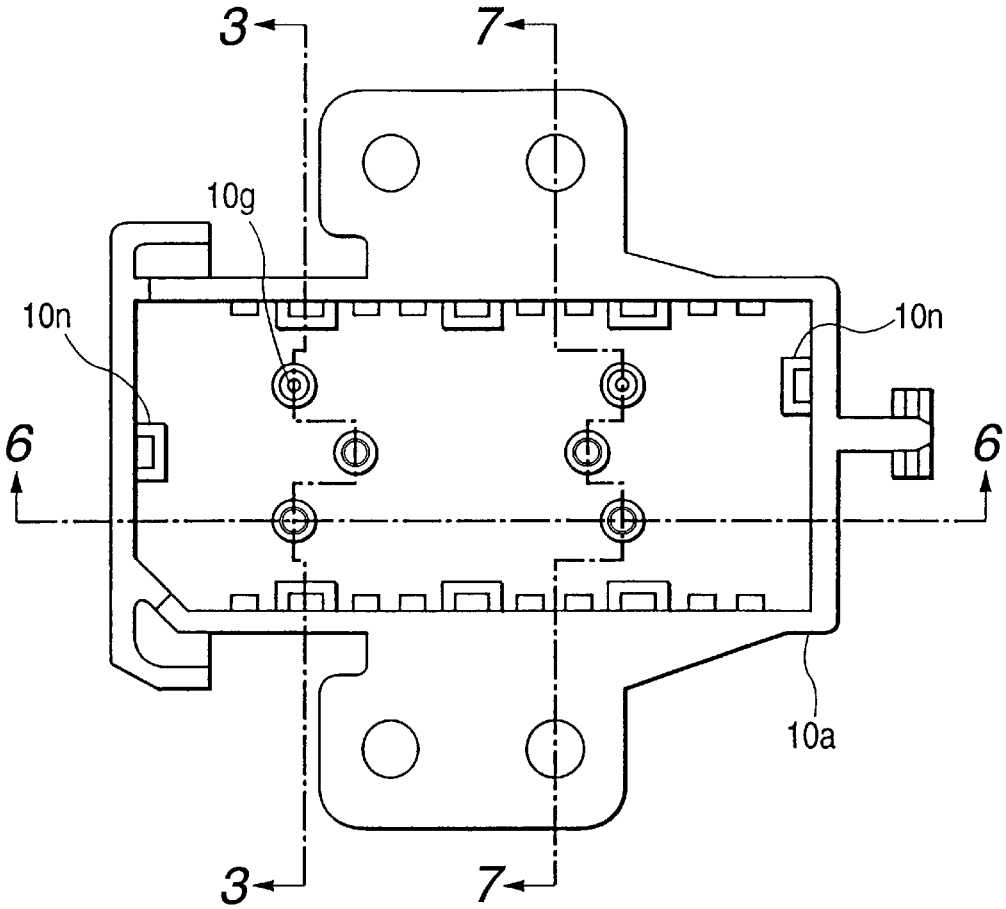
FIG. 2 is a plan showing an example of a cap case of a capping member mounted in the recording apparatus shown in FIG. 1.
Figure 3:
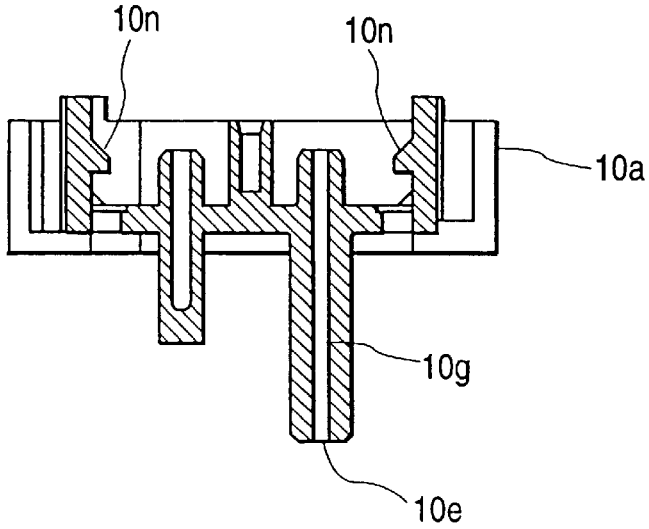
FIG. 3 is a sectional view showing a capping member according to a first embodiment of the present invention.

FIG. 2 is a plan showing an example of the cap case in the above capping member 10, FIG. 3 is a section view taken along the line A—A in FIG. 2, which shows a first embodiment of the present invention.

Figure 24:
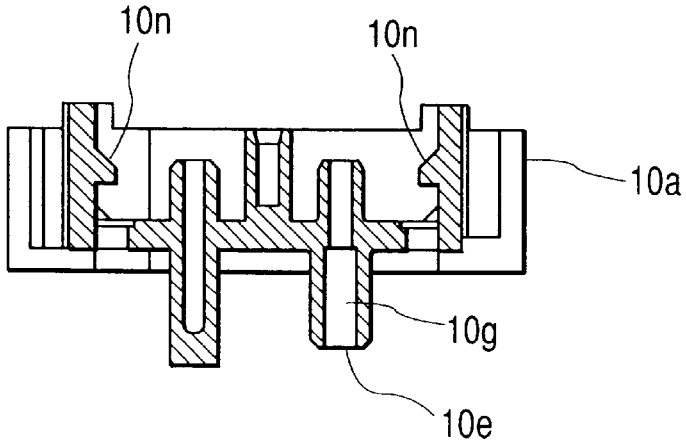
FIG. 24 is a sectional view showing an example of a cap case in the related capping member.

FIG. 3 is shown so that it can be compared with the above related structure shown in FIG. 24. Parts in FIGS. 2 and 3 equivalent to the above parts in FIGS. 23 and 24 are denoted by the same reference numbers and therefore, the description is omitted.

In the structure shown in FIG. 3, only the cap case as described above is shown and the cap 10*b* formed by flexible material is fitted to fitting members 10*n* and housed inside the cap case 10*a*.

A passage 10*g* for connecting the internal space of the cap and a suction hole 10*e* is formed in a cylindrical body integrated with the bottom of the cap case 10*a*.

The inner diameter of the passage log formed in the above cylindrical body is formed so that it is thinner as it can be understood when the above inner diameter is compared with the inner diameter of the passage shown in FIG. 24, the above passage 10*g* is formed so that it is longer and the passage is constituted so that a tube T1 to the suction pump 11 is connected to the suction hole 10*e* formed at the lower end thereof.

Owing to such structure, flow resistance on the side of the suction pump becomes larger and the vaporization of an ink solvent from a tube T1 which is inferior in the gas-barrier characteristic can be effectively inhibited.

As a result, the nozzle orifices of the recording head while the recording apparatus is halted is prevented from drying and the reliability of printing operation when the operation of the recording apparatus is restarted can be secured.

Figure 4:
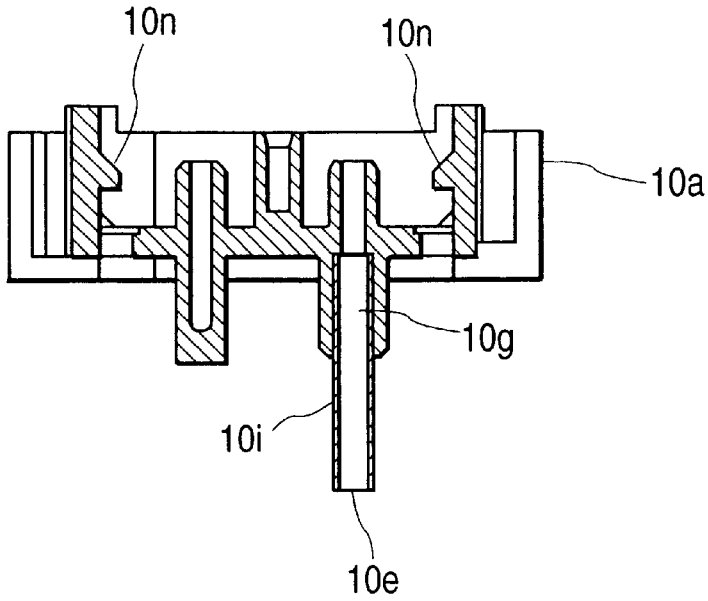
FIG. 4 is a sectional view showing a capping member according to a second embodiment of the present invention.
Figure 5:
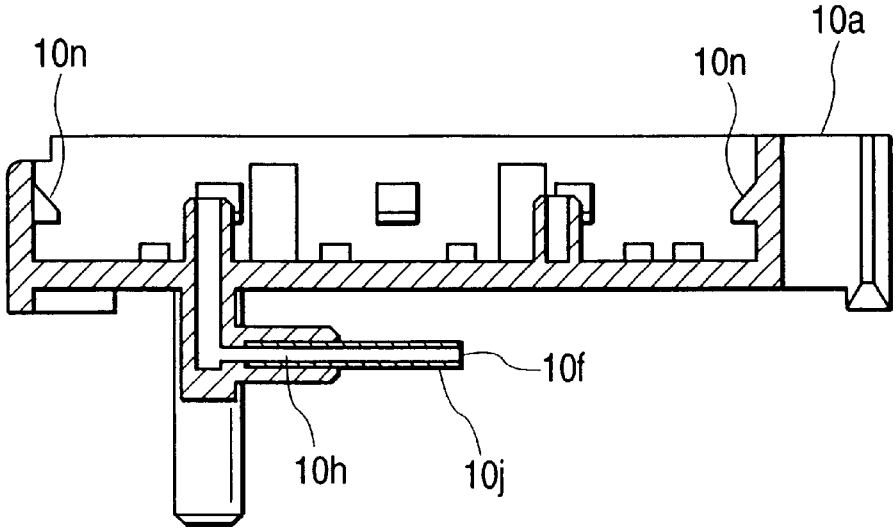
FIG. 5 is a sectional view showing the capping member viewed from a direction perpendicular to FIG. 4.

Next, FIGS. 4 and 5 show a second embodiment of the present invention and the same reference number is allocated to a part equivalent to the part already described.

FIG. 4 is a sectional view corresponding to a part equivalent to the cutting plane line A—A shown in FIG. 2 and shows that a tube member 10*i* made of stainless steel or the like is inserted into a passage 10*g* for making the internal space of a cap and suction hole 10*e* communicate.

A tube T1 which leads to a suction pump 11 is connected to the lower end of the tube member 10*i*.

FIG. 5 is a sectional view corresponding to a part equivalent to the cutting plane line B—B shown in FIG. 2 and a tube member 10*j* made of stainless steel or the like is inserted into a passage 10*h* for making the internal space of the cap and an air hole 10*f* communicate.

In this embodiment, the tube member 10*j* is inserted into a distal end portion of the L-shaped passage 10*h* so as to extend in substantially parallel with the bottom face of a cap case 10*a*.

A tube T2 which leads to an air introduction valve 14 is connected to the tube member 10*j*.

Owing to such structure, the vaporization of an ink solvent can be effectively inhibited because of the above tube members 10*i* and 10*j* respectively made of stainless steel, flow resistance on the side of the suction pump 11 and flow resistance on the side of the air valve 14 can be regulated by selecting the inside diameter and the length of the tube members 10*i* and 10*j* as in the example shown in FIG. 3 and the vaporization of an ink solvent from the tube which is inferior in the gas-barrier characteristic can be effectively inhibited.

If no tube member made of stainless steel is inserted, the inside diameter of the passages 10*g* and 10*h* is limited because of a problem in forming the cap case, however, hereby, the problem is solved and a passage having a smaller diameter can be formed.

Figure 6:
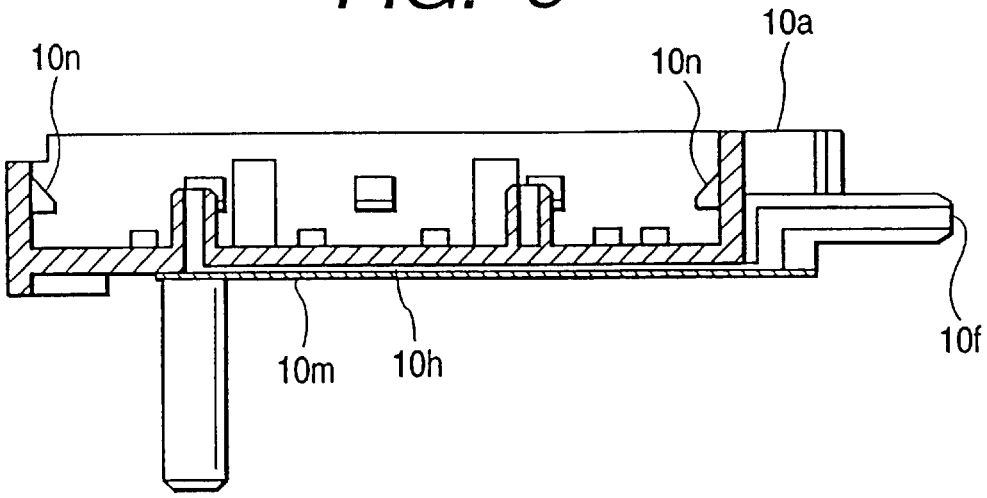
FIG. 6 is a sectional view showing a capping member according to a third embodiment of the present invention.
Figure 7A:
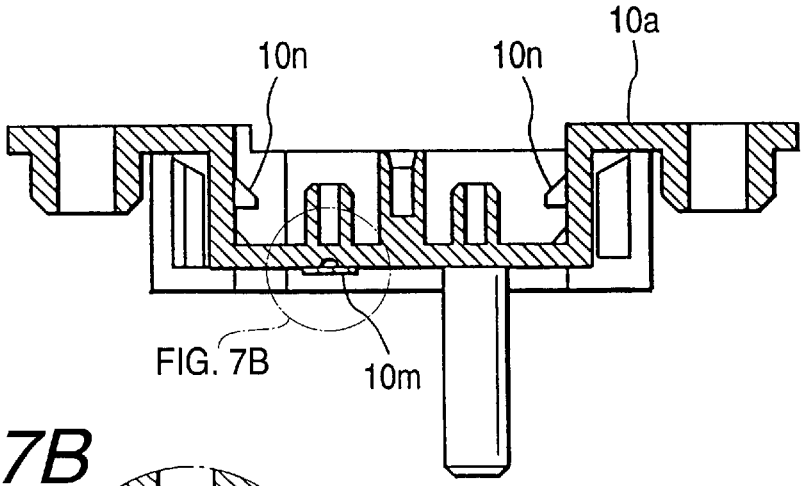
FIG. 7 is a sectional view showing the capping member viewed from a direction perpendicular to FIG. 6.
Figure 7B:
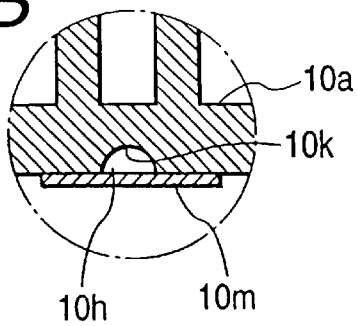

Next, FIGS. 6 and 7 show a third embodiment of the present invention and the same reference number is allocated to a part equivalent to the part already described.

FIG. 6 is a sectional view corresponding to a part equivalent to the cutting plane line B—B shown in FIG. 2 and FIG. 7 is a sectional view corresponding to a part equivalent to the cutting plane line C—C shown in FIG. 2.

In the example shown in FIGS. 6 and 7, a passage for making the internal space of a cap and an air hole communicate is composed of a groove formed along the outer peripheral portion of a cap case and a sealing member covering the groove.

That is, at the bottom a part of which is enlarged in a circle shown in FIG. 7 of the cap case 10*a*, the groove 10*k* the section of which is in the shape of an arc is formed in the longitudinal direction of the cap case 10*a*.

The end of the groove 10*k* communicates with the internal space of the cap and the sealing member 10*m* formed in a strip to cover the groove 10*k* is stuck with the sealing member integrated with the cap case 10*a*.

It is desirable that the above sealing member 10*m* is made of material excellent in the gas-barrier characteristic and it is suitable that material composed of a monolayer selected out of an aluminum (Al) deposited film, a silicon oxide ($SiO_x$) deposited film, polyethylene terephthalate (PET), undrawn polypropylene (CPP), ethylene-vinylalcohol (EVOH), ethylene-vinyl acetate copolymer (EVA), polyvinylidene chloride (PVDC), and cyclic olefin copolymer (COC) or a member acquired by laminating material composed of a monolayer is stuck by thermal welding.

At the end of the groove 10*k*, an air hole 10*f* for connecting a tube T2 which leads to an air introduction valve 14 is protruded from the cap case 10*a*.

The above air hole 10*f* may be previously made of the same synthetic resin material as the cap case 10*a* as another member which is to be welded onto the cap case 10*a* by an ultrasonic wave.

A passage 10*h* for making the internal space of the cap and the air hole 10*f* communicate is composed of the above groove 10*k* and the sealing member 10*m* covering the groove 10*k*, and therefore, the passage which is smaller in a diameter and longer can be formed by regulating the cross section and the length of the groove 10*k*.

Hereby, flow resistance on the side of the air introduction valve 14 can be regulated and the vaporization of an ink solvent from the tube and the air introduction valve 14 can be effectively inhibited.

Figure 8:
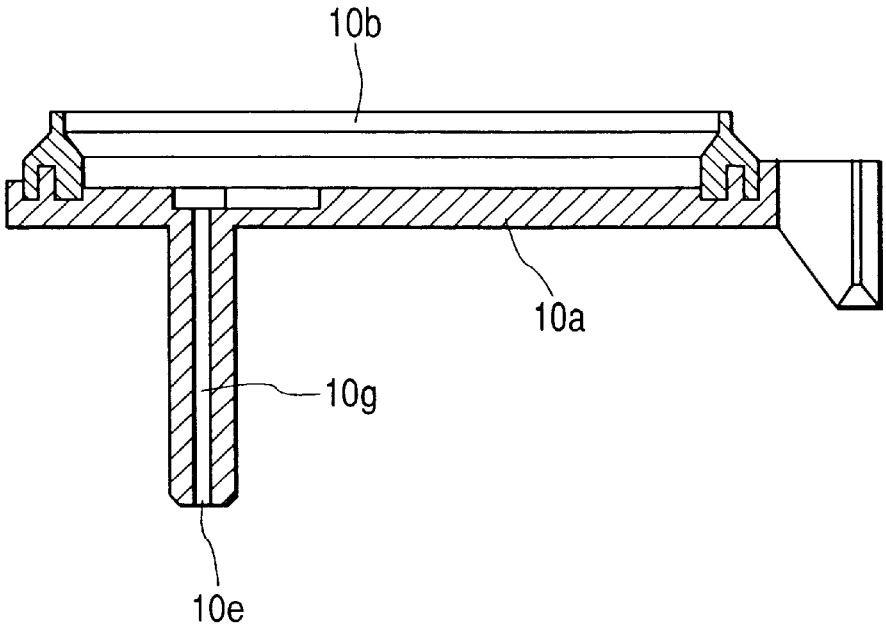
FIG. 8 is a sectional view showing a capping member according to a fourth embodiment of the present invention.

Next, FIG. 8 shows a fourth embodiment of the present invention and the same reference number is allocated to a part equivalent to the part already described.

This embodiment is characterized in that a cap 10*b* is integrally formed with a cap case 10*a* by molding.

A passage log for making internal space formed by the cap case 10*a* and the cap 10*b* and a suction hole 10*e* communicate is formed inside a cylindrical body integrated with the bottom of the cap case 10*a*.

The inner diameter of the passage 10*g* formed inside the above cylindrical body is formed so that it is thinner than that shown in FIG. 24, the passage 10*g* is formed so that it is longer and a tube T1 which leads to a suction pump 11 is connected to the suction hole 10*e* formed at the lower end.

Figure 9:
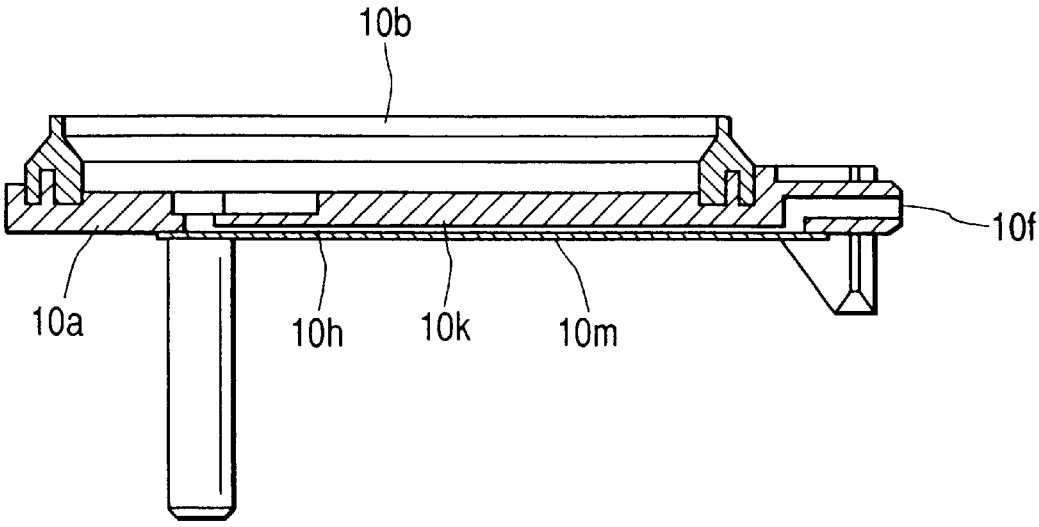
FIG. 9 is a sectional view showing a capping member according to a fifth embodiment of the present invention.

FIG. 9 shows a fifth embodiment of the present invention and the same reference number is allocated to a part equivalent to the part already described.

This embodiment is characterized in that a cap 10*b* is integrally formed with a cap case 10*a* by molding as well as the fourth embodiment.

A passage for making internal space formed by the cap case 10*a* and the cap 10*b* and an air hole 10*f* communicate is composed of a groove 10*k* formed along the bottom face of the cap case 10*a* and a sealing member 10*m* covering the groove.

The passage 10*h* is formed by the sealing member 10*m* formed in a strip for covering the groove 10*k* and the above sealing member 10*m* is made of material excellent in the gas-barrier characteristic described in relation to FIG. 6.

Figure 10:
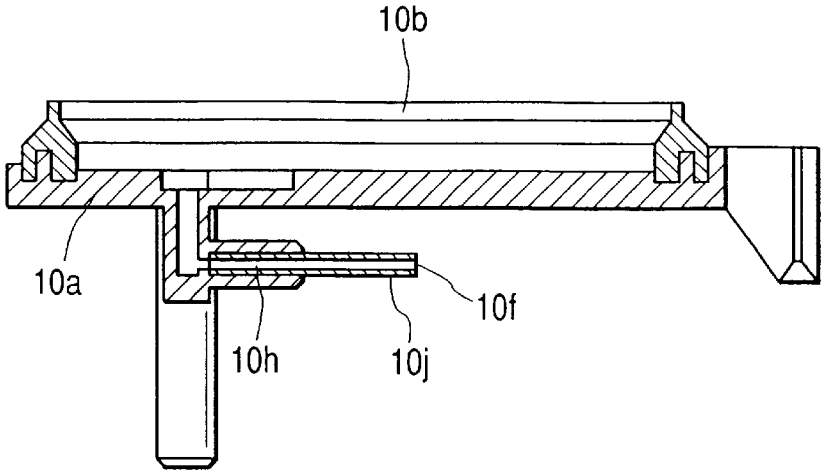
FIG. 10 is a sectional view showing a capping member according to a sixth embodiment of the present invention.

FIG. 10 shows a sixth embodiment of the present invention and the same reference number is allocated to a part equivalent to the part already described.

This embodiment is characterized in that a cap 10*b* is integrally formed with a cap case 10*a* by molding. The other structure is substantially similar to the second embodiment shown in FIG. 4.

Figure 11:
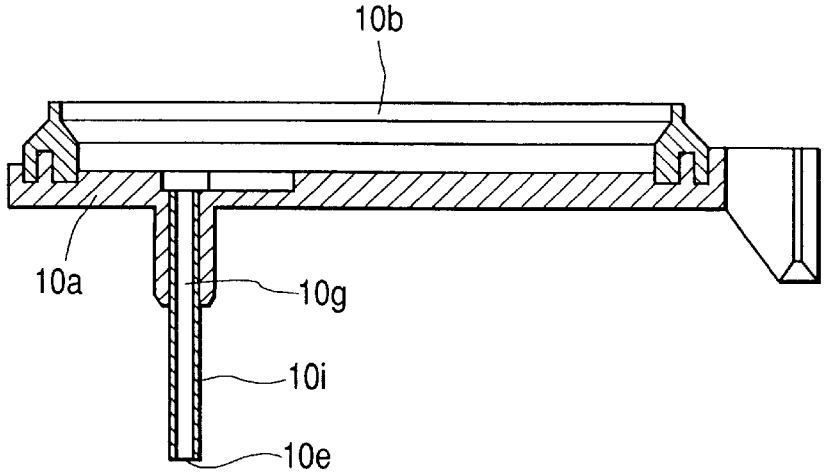
FIG. 11 is a sectional view showing a capping member according to a seventh embodiment of the present invention.

Next, FIG. 11 shows a seventh embodiment of the present invention and the same reference number is allocated to a part equivalent to the part already described.

This embodiment is characterized in that a cap 10*b* is integrally formed with a cap case 10*a* by molding. The other structure is substantially similar to the second embodiment shown in FIG. 4.

Figure 12:
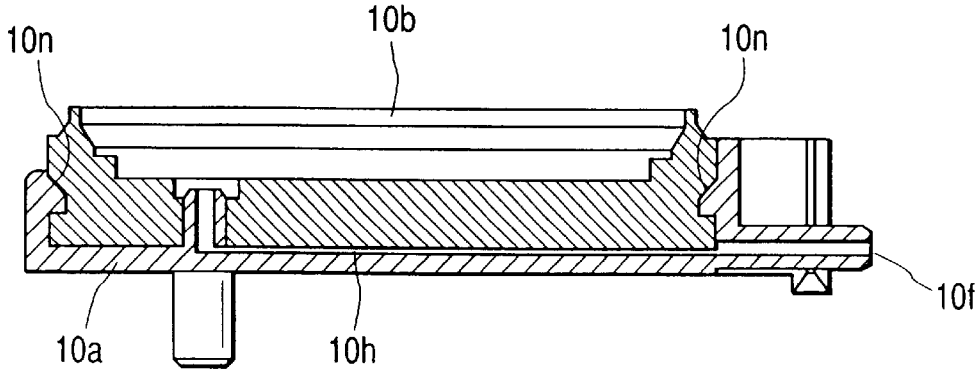
FIG. 12 is a sectional view showing a capping member according to an eighth embodiment of the present invention.
Figure 13:
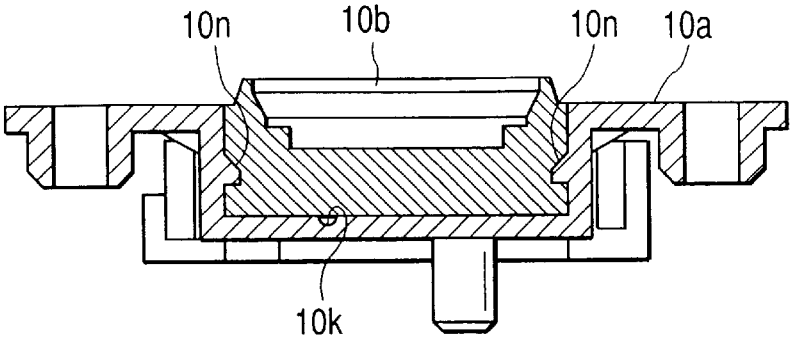
FIG. 13 is a sectional view showing the capping member viewed from a direction perpendicular to FIG. 12.

Further, FIGS. 12 and 13 show an eighth embodiment of the present invention and show a sectional state in directions mutually perpendicular.

The same reference number is allocated to a part equivalent to the part already described.

In this embodiment, a groove 10*k* is formed on a top face of a cap case 10*a*, and the opened face of the groove 10*k* is sealed by a bottom face of a cap 10*b* to form a passage 10*h* for making the internal space of the cap 10*b* and an air hole 10*f* communicate.

Figure 14:
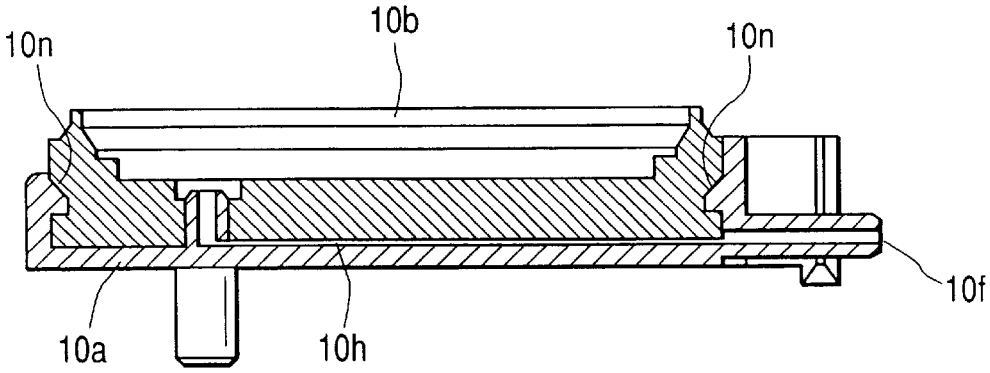
FIG. 14 is a sectional view showing a capping member according to a ninth embodiment of the present invention.
Figure 15:
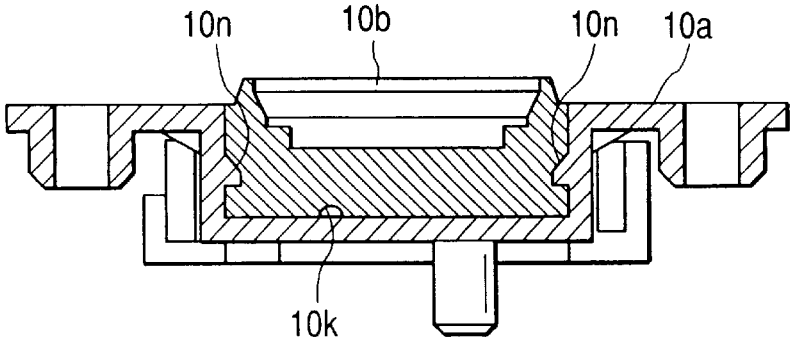
FIG. 15 is a sectional view showing the capping member viewed from a direction perpendicular to FIG. 14.

FIGS. 14 and 15 show a ninth embodiment of the present invention and show a sectional state in directions mutually perpendicular.

The same reference number is allocated to a part equivalent to the part already described.

In this embodiment, a groove 10*k* is formed on a bottom face of a cap 10*b* , and the opened face of the groove 10*k* is sealed by a top face of a cap case 10*a* to form a passage 10*h* for making the internal space of the cap 10*b* and an air hole 10*f* communicate.

Each passage described in the above embodiments can be applied to both of the passage which leads to the suction hole to which the suction pump is connected and the passage which leads to the air hole to which an air introduction valve is connected.

As has been described heretofore, according to the present invention, since the passage for communicating the internal space of the capping member with the suction hole to which the negative pressure generating member is connected, or the passage for communicating the above internal space with the air hole to which the air introduction valve communicate is connected is formed in the cap case or between the cap case and the cap, the vaporization of an ink solvent in the cap case can be effectively inhibited owing to the passage.

Hereby, the vaporization of an ink solvent from the tube which is inferior in the gas-barrier characteristic can be effectively inhibited and the moist state of an ink solvent in the capping member can be maintained for a long term.

Therefore, the reliability of printing operation when printing is restarted after the long-term halt of a recording apparatus can be enhanced.

Figure 16:
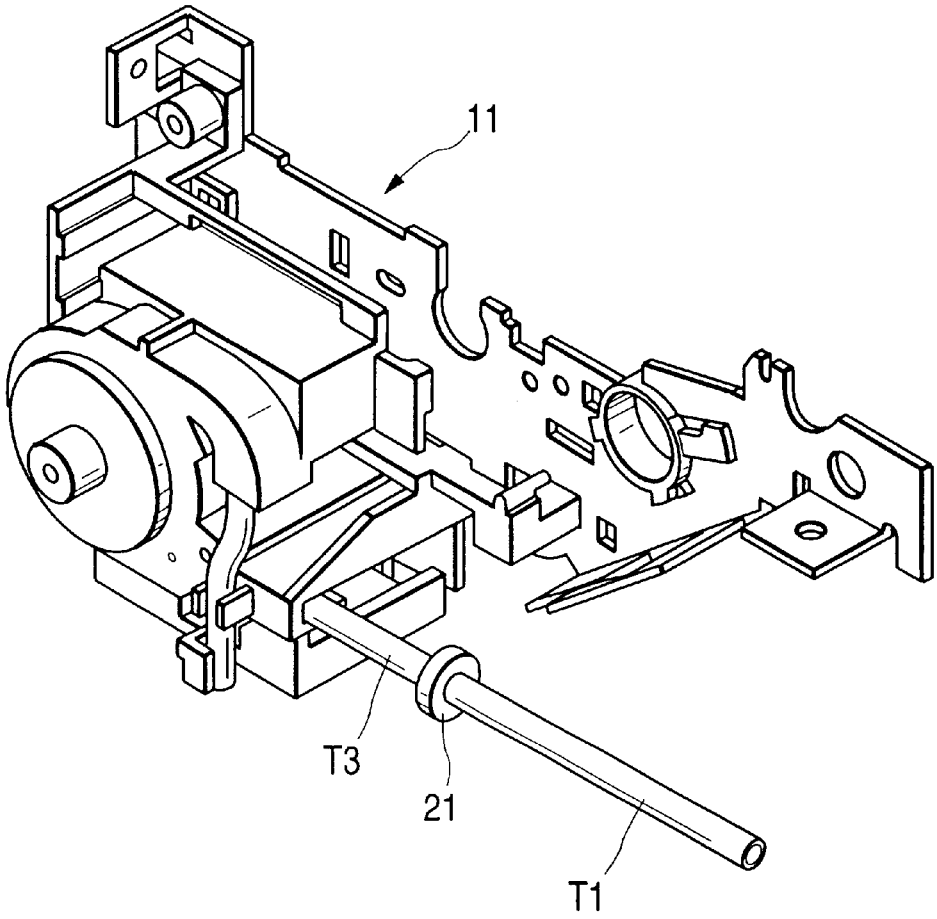
FIG. 16 is a perspective view showing a state in which a suction pump mounted in the recording apparatus of FIG. 1 and a tube are connected.
Figure 17:
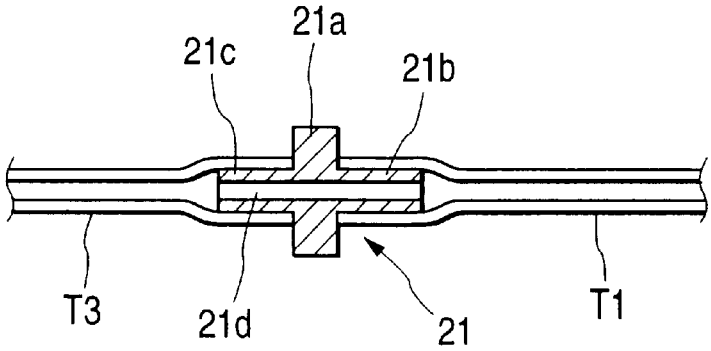
FIG. 17 is a sectional view showing an example of a state in which a tube on the side of the capping member and a tube on the side of the suction pump are connected.

FIG. 16 is a perspective view showing the suction pump 11, which constitutes a tube pump as described later.

A tube (a second tube) T3 constituting the tube pump is connected to the first tube T1 connected to the suction hole 10*e* in the above capping member 10 via a connecting member 21 described later.

In this case, the first tube T1 connected to the suction hole 10*e* formed in the capping member 10 is made of material excellent in the gas-barrier characteristic and preferably, butyl rubber is used.

The second tube T3 constituting the tube pump is made of elastic and restorable material to fulfill the function of a tube pump and preferably, silicon rubber is used.

The connecting member 21 is provided with a flange 21*a*, tube connections 21*b* and 21*c* respectively formed both sides thereof and a through hole 21*d* piercing therethrough. The above first tube T1 and the second tube T3 are respectively connected to the tube connections 21*b* and 21*c* in order to be communicated with each other.

Figure 18A:
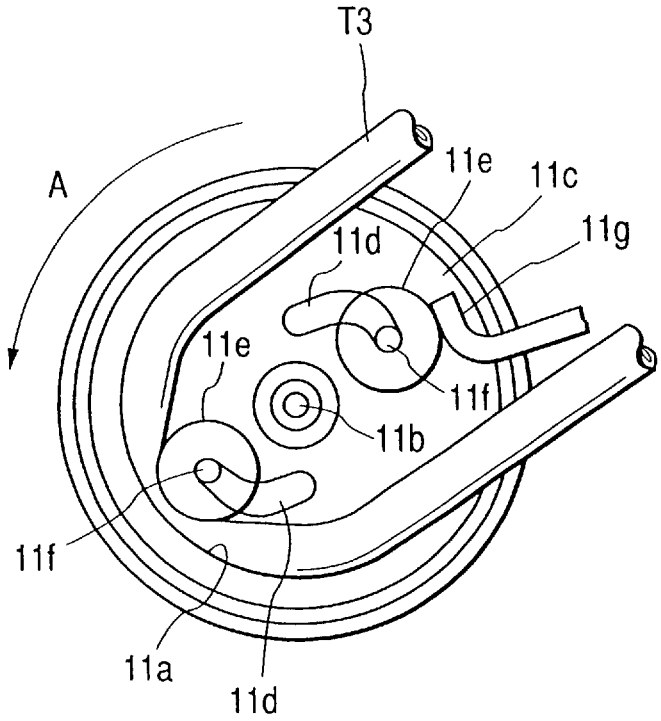
FIGS. 18A and 18B show an example of the internal constitution of the suction pump.
Figure 18B:
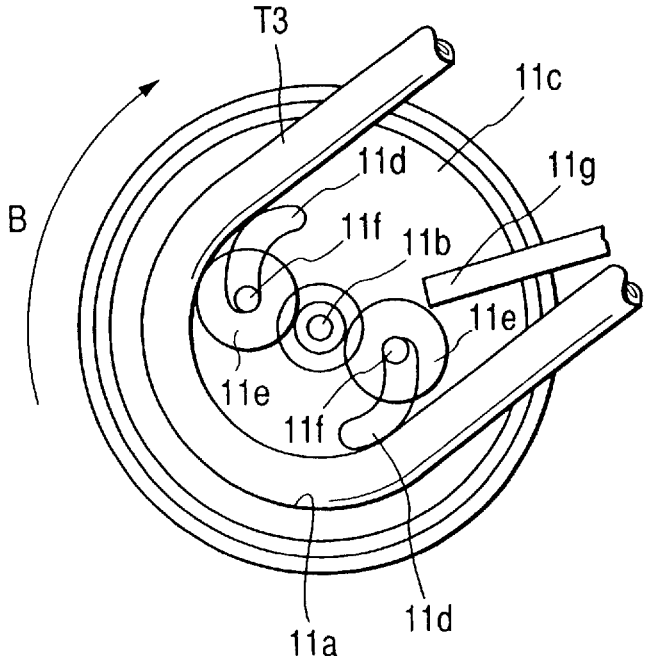

FIGS. 18A and 18B show an example of the internal structure of the above suction pump 11.

In the above suction pump 11, there is formed an supporting face 11*a* for supporting the tube T3 by substantially 180° in the shape of an arc.

A wheel 11*c* is provided with a driving shaft 11*b* in the center thereof and a pair of curved grooves 11*d* extended from the inner to outer diameter of the wheel 11*c*. A spindle 11*f* of a roller 11*e* is fitted into each groove 11*d* so that the spindle can be moved along the above groove 11*d* to rotate the roller.

A press member 11*g* made of an elastic material such as rubber is disposed on the rotation orbital of the roller 11*e*.

FIG. 18A shows a state in which the driving shaft 11*b* of the wheel 11*c* is rotated in one direction, that is, in a direction shown by an arrow A and in this case, the roller 11*e* is moved by the press member 11*g* along the groove 11*d* toward the periphery of the wheel 11*c*.

Therefore, the roller 11*e* is rolled while pressing the tube T3 onto the supporting face 11*a* as the wheel 11*c* is rotated in the direction shown by the arrow A.

As the above rollers 11*e* are arranged at an interval of 180° in the wheel 11*c*, the respective rollers 11*e* sequentially stroke the tube T3 and hereby, negative pressure is generated inside the tube.

The above negative pressure is applied to the capping member through the first tube T1 via the connecting member 21 as described above.

FIG. 18B shows a state in which the driving shaft 11*b* of the wheel 11*c* is rotated in the other direction, that is, in a direction shown by an arrow B and in this case, the roller 11*e* is moved by the press member 11*g* along the groove 11*d* toward the shaft 11*b*. Thus, a state in which the tube T3 is pressed by the roller 11*e* is released.

As has been described heretofore, for the passage communicating the capping member with the negative pressure generating member, since the first tube made of the material excellent in the gas-barrier characteristic is used on the side of the capping member and the second tube made of the elastic and restorable material is used on the side of the negative pressure generating member, the vaporization of an ink solvent in the capping member can be effectively inhibited.

Hereby, the moist state of an ink solvent in the capping member can be maintained for a long term and the reliability of printing operation when printing is restarted after the long-term halt of the recording apparatus can be enhanced.

Figure 19:
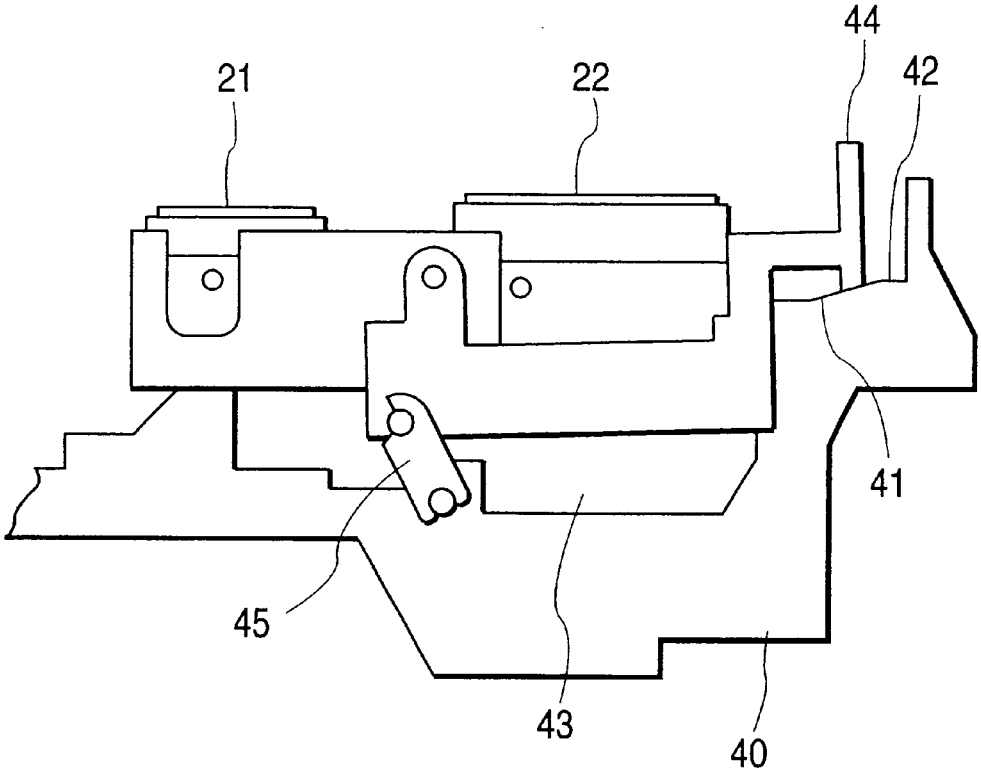
FIG. 19 shows an embodiment of a capping unit.

FIG. 19 shows an embodiment of a capping unit according to the present invention, a guide part composed of an upward tilted part 41 extended from the side of the leading end of a home position to the side of the trailing end (from the left to the right in FIG. 19) and a horizontal part 42 is provided on both sides of a cap frame 40 and the projection of a slider 43 is attached to the guide part so that the slider can be slid.

On the side of the trailing end of the slider 43, a contact piece 44 which is to be abutted against the carriage 1 is formed, is held by a lever 45 rotationally urged by a spring (not shown) toward the leading end of the home position. Capping member 21 and 22 to which the present invention is applied is disposed on a top face of the slider 43 for sealing the nozzle orifices of the recording head 7.

Figure 20A:
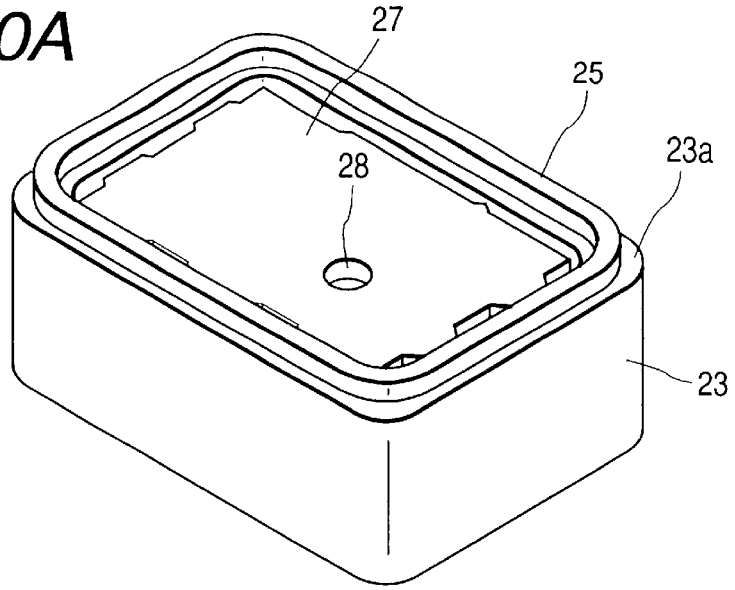
FIGS. 20A to 20E are sectional views showing examples of a cap in the capping unit.
Figure 20B:
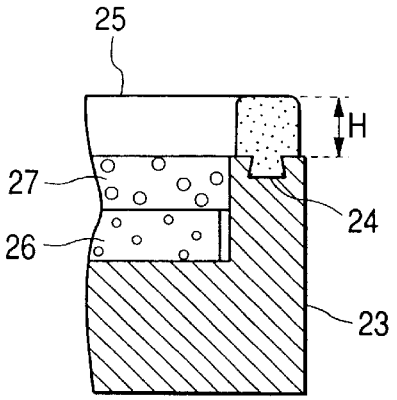
Figure 20C:
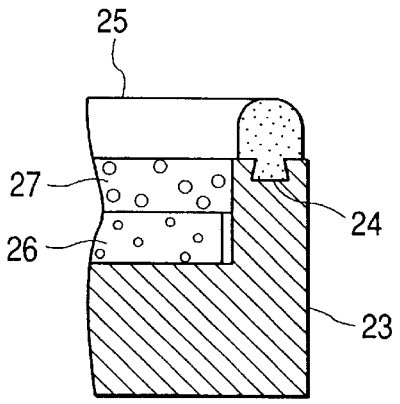
Figure 20D:
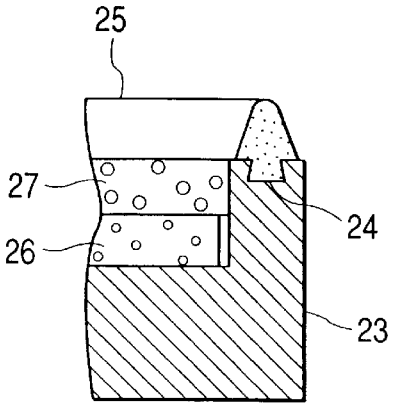
Figure 21A:
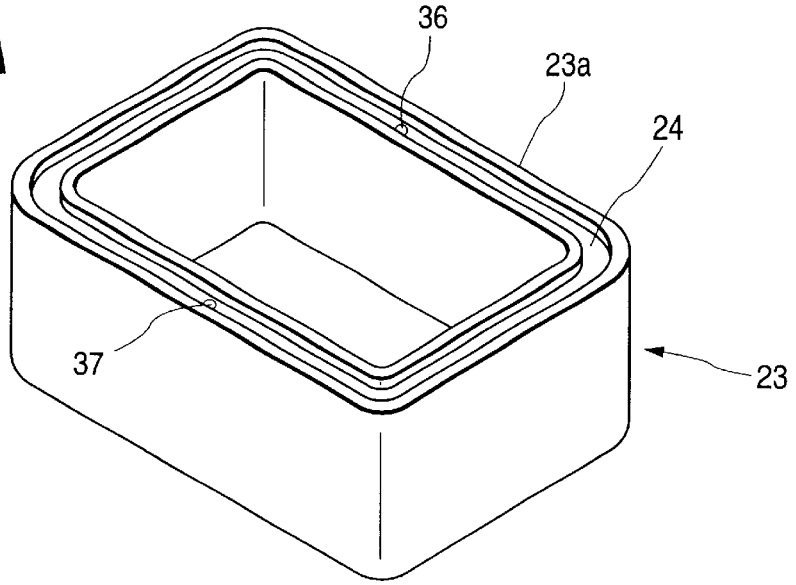
FIGS. 21A to 21C are views for explaining a manufacturing process of the cap.

FIG. 20A shows an embodiment of the capping members 21 and 22, a main body 23 is formed by the injection molding of polymeric material such as polypropylene or polyethylene, or composites of the above polymeric material and polystyrene, so that the body is in the shape of a cup provided with the bottom. On an opened face 23*a*, an annular groove 24 is formed as shown in FIG. 21A. A packing part 25 made of a material having durability for ink such as styrene thermoplastic elastomer and styrene thermoplastic elastomer composite and easy to fit to a nozzle plate is integrally fitted into the groove 24.

Particularly, for styrene thermoplastic elastomer as packing material, for example, a trade name "Toughtec S2953" manufactured by Asahi Chemical Industry Co., Ltd., a trade name "Septon Compound CJ-103" manufactured by Kuraray Co., Ltd., a trade name "Actimer AJ-1020N" manufactured by Riken Vinyl Co., Ltd. and a trade name "Rubberon T320C" manufactured by Mitsubishi Chemical Industries, Ltd. and for styrene thermoplastic elastomer composite materials, for example, a trade name "MNCS SR" manufactured by Bridgestone Tire Co., Ltd. are respectively high in the resistance to ink and in addition, are satisfactory in adhesiveness to the nozzle plate of the recording head and are extremely desirable material to prevent nozzle orifices from being clogged and to securely apply negative pressure when ink is sucked to the recording head.

As shown in FIGS. 20B to 20E, the packing part 25 may be formed so that the section thereof is in a shape suitable for sealing the recording head such as substantially rectangular, semicircular, triangular and trapezoidal.

Figure 20E:
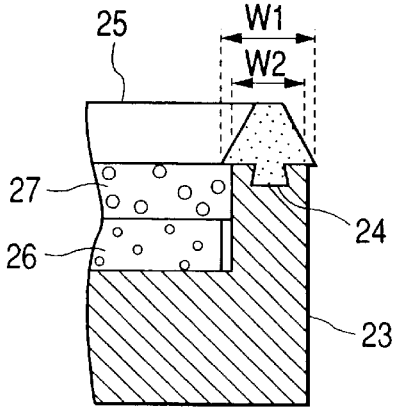

To take a shape shown in FIG. 20E as an example, it is desirable that the width w1 of the bottom of the packing part 25 is equal to or wider than the width w2 of the opened face (brim) 23*a* of the cup-shaped main body 23.

Ink absorbing sheets 26 and 27 made of porous material are filled inside the main body 23 and an open part 28 communicating with a pump unit 11 is formed.

Figure 21B:
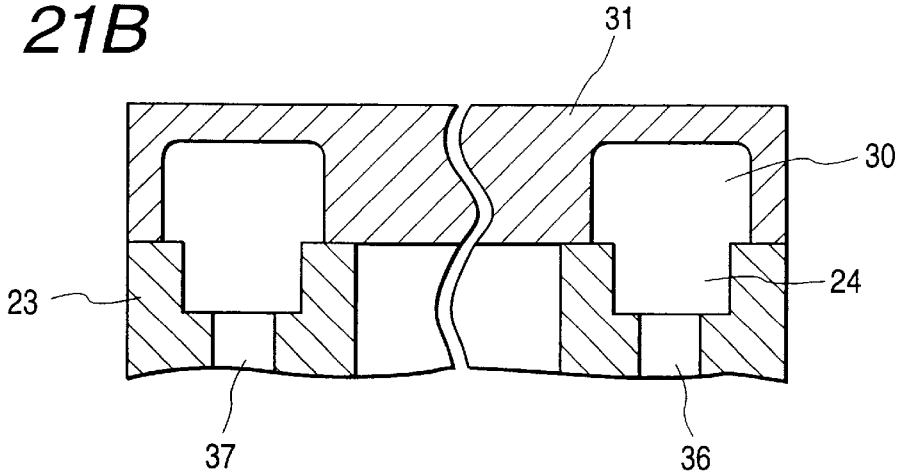
Figure 21C:
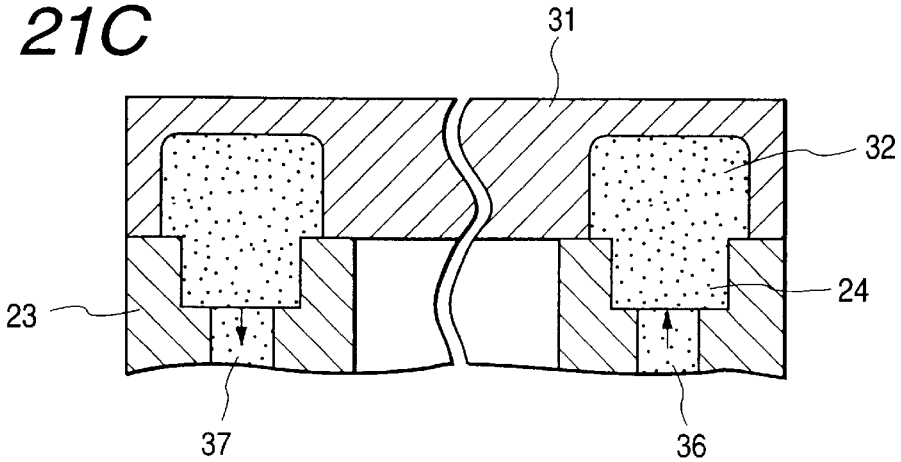

A manufacturing method for the capping members 21 and 22 will be described. First, there is prepared the main body 23 on the opened face 23*a* of which an annular groove 24, an air inlet 36 and an air outlet 37 respectively communicating with the outside via the groove 24 are formed as shown in FIG. 21A. The opened face is sealed by a mold 31 provided with concave portions 30 each of which is equivalent to the sectional shape of the packing part 25 as shown in FIG. 21B. Then packing material 32 such as styrene thermoplastic low-hardness elastomer is injected from the inlet 26, the packing material 32 flows into the groove 24 and the concave portions 30, exhausting air in the groove 24 and the concave portions 30 from the outlet 27 as shown in FIG. 21C.

When the mold 31 is removed after the packing material 32 is hardened and fixed on the main body 23, the capping members 21 and 22 the packing part 25 of each of which is integrated with the opened face 23*a* of the main body 23 are completed.

In the above embodiment, the packing material 32 is injected from the main body 23, however, if an inlet and an air outlet are formed in a place except an area to be a sealed part of the mold 31, for example on the side and the packing material is injected, the similar action is also produced.

In this embodiment, when the carriage 1 is moved in a capping position, the capping members 21 and 22 are moved on the side of the recording head and the packing part 25 is brought into contact onto the nozzle plate of the recording head.

When a slider is moved to a predetermined position, the packing part 25 is elastically deformed to seal the nozzle plate.

Originally, as the packing part 25 is held on the rigid main body 23, the useless deformation is inhibited and airtightness is secured by uniformly elastically deforming the whole periphery owing to elasticity controlled depending upon the height H of the packing part 25, sealing performance is maintained for a long term.

If ink cartridges are replaced, the carriage 1 is moved in the capping position, the recording head 7 is sealed by the packing part 25 and negative pressure is supplied from the suction pump 11.

Hereby, ink flows out of the recording head 7 and bubbles left in an ink passage in the recording head 7 and others are also exhausted from the capping member 21 (22) together with ink.

Figure 22:
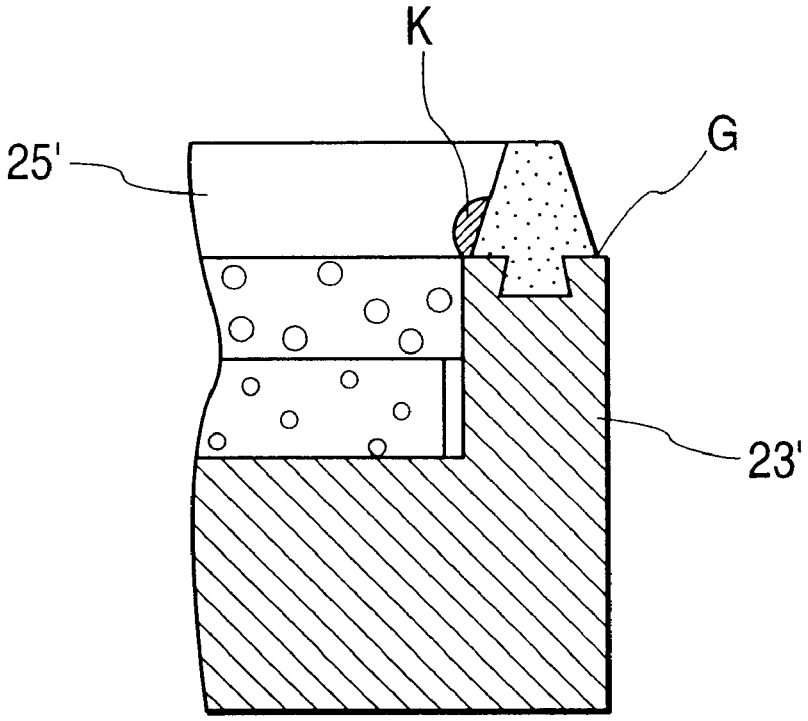
FIG. 22 shows a state after ink is sucked of a cap in a comparative example.

At this time, a part of ink wets the packing part 25, however, as the width w1 of the bottom of the packing part 25 is formed so that it is wider than the width w2 of the opened face (brim) 23*a* of the cup-shaped main body 23, no thin gap G exists on the side of the face opposite to nozzles shown in FIG. 22 between a packing part 25' and the main body 23', therefore, no ink pool K is made at least in the vicinity of the nozzle plate and ink can be prevented from adhering to the nozzle plate again.

As has been described heretofore, according to the present invention, since the annular groove is formed on the opened face of the cup-shaped body provided with the opening for covering the nozzle orifices of the recording head, and the packing part elastically deformable when it is brought into contact with the recording head is formed on the groove, not only the process can be simplified, compared with two-body structure but uniform airtightness between the whole periphery and the recording head can be secured for a long term by elasticity controlled depending upon the height of the packing part, holding the packing part on the rigid body to prevent useless deformation.

What is claimed is:

1. An ink jet recording apparatus comprising:

an ink jet recording head having a surface provided with nozzle orifices from which ink droplets are ejected; and a capping member for sealing the surface provided with the nozzle orifices to apply negative pressure generated by a negative pressure generating member, the capping member including:

a cap made of flexible material, which is to be abutted against the surface provided with the nozzle orifices and which defines an internal space;

a cap case for holding the cap;

a suction hole to which the negative pressure generating member is connected;

a first passage formed in either the cap or the cap case for communicating an internal space defined by said cap with the suction hole;

an air hole to which a valve introducing external air into the internal space; and a second passage formed in either the cap and the cap case for communicating the internal space with the air hole, wherein flow resistance of the first passage is larger than flow resistance of the second passage.

2. The ink jet recording apparatus as set forth in claim 1, wherein the cap is bonded on an inner face of the cap case.

3. The ink jet recording apparatus as set forth in claim 1, wherein the cap is integrally formed on an upper portion of the cap case.

4. The ink jet recording apparatus as set forth in claim 3, wherein at least the first passage between both of the first and second passages are formed by a groove formed along an outer peripheral face of the cap case and a seal member for sealing the groove.

5. The ink jet recording apparatus as set forth in claim 4, wherein the sealing member is made of at least one material selected from the group consisting of an aluminum deposited film, a silicon oxide deposited film, polyethylene terephthalate, undrawn polypropylene, ethylene-vinylalcohol, ethylene-vinyl acetate copolymer, polyvinylidene chloride, and cyclic olefin copolymer.

6. The ink jet recording apparatus as set forth in claim 1, wherein a cylindrical body is integrally formed with the cap case so as to protrude from a bottom face of the case, and wherein the first passage is formed in the cylindrical body.

7. The ink jet recording apparatus as set forth in claim 1, wherein a metal tube member is inserted into the suction hole.

8. The ink jet recording apparatus as set forth in claim 1, wherein the cap case is formed into a shape of cup having a brim surface on which an annular groove into which the cap is fitted is formed, and wherein the cap is an elastic packing member.

9. The ink jet recording apparatus as set forth in claim 8, wherein the cap case is made of polymeric material, and the cap is made by injection molding of the flexible material.

10. The ink jet recording apparatus as set forth in claim 9, wherein the width of a bottom face of the cap is equal or wider than the width of the brim portion of the cap casing.

11. The ink jet recording apparatus as set forth in claim 9, wherein the cap is bonded onto the brim portion of the cap case.

12. The ink jet recording apparatus as set forth in claim 9, wherein the cap case is made of either polypropylene or polyethylene, and wherein the cap is made of either styrene thermoplastic elastomer or styrene thermoplastic elastomer composite materials.

13. The ink jet recording apparatus as set forth in claim 9, wherein the groove has a portion communicating with the outside.

14. The ink jet recording apparatus as set forth in claim 9, wherein the injection molding is conducted by the steps of:

sealing the groove on the brim portion by a mold defining a shape of the cap; and injecting the material which is to be the cap into the mold.

15. The ink jet recording apparatus as set forth in claim 14, wherein a first port from which the material which is to be the cap is injected and a second port from which air in the mold is discharged is formed in either the groove on the brim portion or the mold.

16. The ink jet recording apparatus as set forth in claim 1, further comprising:

a first tube made of a material having high gas-barrier characteristic and connected to the suction hole; and a second tube member made of an elastic and restorative material for connecting the negative pressure generating member with the first tube.

17. The ink jet recording apparatus as set forth in claim 16, wherein the negative pressure generating member is a tube pump including a supporting face for supporting the second tube in the shape of an arc and a roller rotating while pressing the second tube onto the supporting face.

18. The ink jet recording apparatus as set forth in claim 16, wherein a tube made of butyl rubber is used as the first tube, and a tube made of silicon rubber is used as the second tube.

19. An ink jet recording apparatus comprising:

an ink jet recording head having a surface provided with nozzle orifices from which ink droplets are ejected;

a capping member for sealing the surface provided with the nozzle orifices to apply negative pressure generated by a negative pressure generating member;

a first tube connected to the capping member; and a second tube for connecting the negative pressure generating member with the first tube, wherein the first tube has greater gas-barrier characteristic than the second tube; and wherein the second tube has greater elasticity and restorability than the first tube.

20. The ink jet recording apparatus as set forth in claim 19, wherein the negative pressure generating member is a suction pump including a supporting face for supporting the second tube in the shape of an arc and a roller rotating while pressing the second tube onto the supporting face.

21. The ink jet recording apparatus as set forth in claim 19, wherein a tube made of butyl rubber is used as the first tube, and a tube made of silicon rubber is used as the second tube.

22. An ink jet recording apparatus comprising:

an ink jet recording head having a surface provided with nozzle orifices from which ink droplets are ejected; and a capping member for sealing the surface provided with the nozzle orifices to apply negative pressure generated by a negative pressure generating member, the capping member including:

a cap made of flexible material, which is to be abutted against the surface provided with the nozzle orifices and which defines an internal space;

a cap case for holding the cap;

a suction hole to which the negative pressure generating member is connected;

a first passage formed in either the cap or the cap case for communicating the internal space with the suction hole;

an air hole to which a valve introducing external air into the internal space defined the cap; and a second passage formed in either the cap or the cap case for communicating the internal space with the air hole, wherein a metal tube member is inserted into at least one of the suction hole and the air hole.

23. The ink jet recording apparatus as set forth in claim 22, wherein the cap is bonded on an inner face of the cap case.

24. The ink jet recording apparatus as set forth in claim 22, wherein the cap is integrally formed on an upper portion of the cap case.

25. The ink jet recording apparatus as set forth in claim 22, wherein a cylindrical body is integrally formed with the cap case so as to protrude from a bottom face of the case, and wherein at least one of the first passage and the second passage is formed in the cylindrical body.

26. An ink jet recording apparatus comprising:

an ink jet recording head having a surface provided with nozzle orifices from which ink droplets are ejected; and a capping member for sealing the surface provided with the nozzle orifices to apply negative pressure generated by a negative pressure generating member, the capping member including:

a cap made of flexible material, which is to be abutted against the surface provided with the nozzle orifices and which defines an internal space:

a cap case for holding the cap;

a suction hole to which the negative pressure generating member is connected;

a first passage formed in either the cap or the cap case for communicating the internal space with the suction hole;

an air hole to which a valve introducing external air into the internal space defined by the cap; and a second passage formed in either the cap or the cap case for communicating the internal space with the air hole, wherein at least one of the first and second passages are formed by a groove formed along an outer peripheral face of the cap case and a seal member for sealing the groove.

27. The ink jet recording apparatus as set forth in claim 26, wherein the sealing member is made of at least one material selected from the group consisting of an aluminum deposited film, a silicon oxide deposited film, polyethylene terephthalate, undrawn polypropylene, ethylene-vinylalcohol, ethylene-vinyl acetate copolymer, polyvinylidene chloride, and cyclic olefin copolymer.

28. The ink jet recording apparatus as set forth in claim 26, wherein the cap is bonded on an inner face of the cap case.

29. The ink jet recording apparatus as set forth in claim 26, wherein the cap is integrally formed on an upper portion of the cap case.

30. An ink jet recording apparatus comprising:

an ink jet recording head having a surface provided with nozzle orifices from which ink droplets are ejected; and a capping member for sealing the surface provided with the nozzle orifices to apply negative pressure generated by a negative pressure generating member, the capping member including:

a cap made of flexible material, which is to be abutted against the surface provided with the nozzle orifices and which defines an internal space:

a cap case for holding the cap;

a suction hole to which the negative pressure generating member is connected;

a first passage formed in either the cap or the cap case for communicating the internal space with the suction hole;

an air hole to which a valve, for introducing external air into the internal space defined by the cap in cooperation with the negative pressure generating member, is connected; and a second passage formed in either the cap and the cap case for communicating the internal space with the air hole, wherein at least one of the first and second passages is formed by a groove formed on the inner face of the cap case.

31. The ink jet recording apparatus as set forth in claim 30, wherein the cap is bonded on an inner face of the cap case.

32. An ink jet recording apparatus comprising:

an ink jet recording head having a surface provided with nozzle orifices from which ink droplets are ejected; and a capping member for sealing the surface provided with the nozzle orifices to apply negative pressure generated by a negative pressure generating member, the capping member including:

a cap made of flexible material, which is to be abutted against the surface provided with the nozzle orifices and which defines an internal space:

a cap case for holding the cap;

a suction hole to which the negative pressure generating member is connected;

a first passage formed in either the cap or the cap case for communicating the internal space with the suction hole;

an air hole to which a valve, for introducing external air into the internal space defined by the cap in cooperation with the negative pressure generating member, is connected; and a second passage formed in either the cap and the cap case for communicating the internal space with the air hole, wherein at least one of the first and second passages are formed by a groove formed on a bottom face of the cap.

33. The ink jet recording apparatus as set forth in claim 32, wherein the cap is bonded on an inner face of the cap case.

* * * * *